US006994453B2

(12) United States Patent
Blanchard

(10) Patent No.: US 6,994,453 B2
(45) Date of Patent: Feb. 7, 2006

(54) ILLUMINATION DEVICE HAVING A DICHROIC MIRROR

(76) Inventor: Randall D. Blanchard, 12658 Futura St., San Diego, CA (US) 92130

( * ) Notice: Subject to any disclaimer, the term of this patent is extended or adjusted under 35 U.S.C. 154(b) by 129 days.

(21) Appl. No.: 10/394,797

(22) Filed: Mar. 21, 2003

(65) Prior Publication Data

US 2004/0184256 A1 Sep. 23, 2004

(51) Int. Cl.
*F21V 7/04* (2006.01)

(52) U.S. Cl. ..... 362/293; 362/260; 362/263

(58) Field of Classification Search ..... 362/31, 362/260, 171, 583, 293, 2, 263, 84; 40/543, 40/542; 250/461.1, 458.1, 483.1, 486.1; 349/70, 71; 427/67

See application file for complete search history.

(56) References Cited

U.S. PATENT DOCUMENTS 4,500,810 A * 2/1985 Graff ..... 313/486
4,822,145 A * 4/1989 Staelin ..... 349/63
4,882,617 A * 11/1989 Vriens ..... 362/293
4,885,471 A * 12/1989 Telfair et al. ..... 250/461.1
5,813,753 A * 9/1998 Vriens et al. ..... 362/293
6,120,160 A * 9/2000 Nakagawa ..... 362/293
6,186,649 B1 * 2/2001 Zou et al. ..... 362/347
6,488,390 B1 * 12/2002 Lebens et al. ..... 362/231
6,513,949 B1 * 2/2003 Marshall et al. ..... 362/231

OTHER PUBLICATIONS

Kahl, John H., "Understanding Cold Cathode Fluorescent Lamps (CCFL's)", JKL Components Corp., pp. 1-5, AI-007, Nov. 1998.
"Aperture and Reflector Lamps", LCD Lighting, Inc., Nov. 10, 2002.
Edmund Industrial Optics Catalog, pp. 78, 79, and 97, Nov. 2002.
"Cold/Hot Mirrors", www.kruschwitz.com, Jan. 9, 2001.
"Nichia and Osram OPTO Semiconductors Enter Patent Cross License", Nichia Corporation Press Release, Sep. 22, 2002.

* cited by examiner

*Primary Examiner*—John Anthony Ward
*Assistant Examiner*—Bao Q. Truong
(74) *Attorney, Agent, or Firm*—Rodney F. Brown

(57) ABSTRACT

An illumination device is provided, which includes, in series, a fluorescing radiation source, a light selective filter, and a light source. The light selective filter is relatively transmissive of fluorescing radiation and relatively reflective of light. The light source is preferably a fluorescable phosphor. The illumination device further includes in series after the light source, a fluorescing radiation selective filter which is relatively transmissive of light and relatively reflective of fluorescing radiation. The illumination device may be one of several specific devices, such as a fluorescent lamp assembly, a flat panel display backlight assembly, or a white light-emitting diode assembly.

30 Claims, 6 Drawing Sheets

ILLUMINATION DEVICE HAVING A DICHROIC MIRROR

TECHNICAL FIELD

The present invention relates generally to illumination devices, and more particularly to an illumination device employing a dichroic mirror in association with a radiation source capable of fluorescing a phosphor.

BACKGROUND OF THE INVENTION

A conventional fluorescent lamp consists of a sealed tube which has mercury vapor dispersed throughout the tube interior. A phosphor coating is deposited on the inner surface of the lamp tube which faces the tube interior. The lamp tube is formed from a glass which is transmissive of visible light, but is absorptive of ultraviolet (UV) radiation. Operation of the fluorescent lamp is effected by passing an electric current through the interior of the lamp tube, which ionizes the mercury vapor dispersed therein. The ionized mercury vapor emits UV radiation, which is absorbed by the phosphor coating upon contact. The UV radiation fluoresces the phosphor causing the phosphor to emit visible light. The visible light is propagated from the phosphor coating out through the tube to illuminate the surroundings of the fluorescent lamp.

The amount of UV radiation which is converted to visible light is a function of the thickness of the phosphor coating. In particular, the UV radiation conversion efficiency of the fluorescent lamp increases as the thickness of the phosphor coating increases. A thicker phosphor coating provides more active phosphor for the conversion of UV radiation to visible light and also reduces the amount of UV radiation which passes unconverted through the phosphor coating. Unconverted UV radiation passing through the phosphor coating is undesirably lost to absorption by the lamp tube, which reduces UV radiation conversion efficiency.

Although UV radiation conversion efficiency advantageously increases as the thickness of the phosphor coating increases, the light output efficiency of the fluorescent lamp undesirably decreases with increasing thickness of the phosphor coating. A thicker phosphor coating absorbs a larger fraction of the visible light emitted by the phosphor coating before the visible light is able to propagate from the phosphor coating out through the tube. A thicker phosphor coating also absorbs a larger fraction of inwardly propagated visible light which is emitted from the phosphor coating on the opposite side of the tube. Thus, the optimum thickness for the phosphor coating of a conventional fluorescent lamp represents a tradeoff between these two opposing efficiencies, i.e., UV radiation conversion efficiency and light output efficiency. The present invention recognizes a need inter alia for a fluorescent lamp which has improved light output efficiency without diminished UV radiation conversion efficiency or, alternatively, for a fluorescent lamp which has improved UV radiation conversion efficiency without diminished light output efficiency.

Accordingly, it is generally an object of the present invention to provide an illumination device utilizing phosphor for the conversion of fluorescing radiation to visible light, wherein the illumination device has improved light output efficiency without diminished radiation conversion efficiency or, conversely, wherein the illumination device has improved radiation conversion efficiency without diminished light output efficiency. It is another object of the present invention to provide an illumination device utilizing phosphor for the conversion of fluorescing radiation to visible light, wherein the illumination device maximizes the amount of visible light propagated away from the illumination device into the surroundings and minimizes the degree of fluorescing radiation attenuation. It is a further object of the present invention to specifically apply the generalized objectives recited above to the design of fluorescent lamp assemblies. It is still a further object of the present invention to specifically apply the generalized objectives recited above to the design of flat panel display backlight assemblies. It is another object of the present invention to specifically apply the generalized objectives recited above to the design of light-emitting diode (LED) assemblies. It is yet another object of the present invention to specifically apply the generalized objectives recited above to the design of aperture fluorescent lamp assemblies.

These objects and others are accomplished in accordance with the invention described hereafter.

SUMMARY OF THE INVENTION

The present invention is an illumination device comprising in series, a fluorescing radiation source, a light selective filter, and a light source. In accordance with one embodiment the fluorescing radiation source is a UV radiation source and more preferably a UV-emitting ionized gas. In accordance with another embodiment the fluorescing radiation source is a blue LED. The light selective filter is relatively transmissive of fluorescing radiation and relatively reflective of light, preferably comprising a film of a light selective filter composition mounted on a substrate. The light source is preferably a fluorescable phosphor. The illumination device may further comprise in series after the light source, a fluorescing radiation selective filter which is relatively transmissive of light and relatively reflective of fluorescing radiation. The fluorescing radiation selective filter preferably comprises a film of a fluorescing radiation selective filter composition mounted on a substrate. The illumination device may be specifically characterized as one of several specific devices, such as a fluorescent lamp assembly, a flat panel display backlight assembly positionable behind a flat panel display, or a white LED assembly.

In accordance with an alternate embodiment, the illumination device of the present invention comprises in series, a fluorescing radiation source, a light source, and a fluorescing radiation selective filter, which is relatively transmissive of light and relatively reflective of fluorescing radiation. The illumination device may further comprise in series between the light source and the fluorescing radiation selective filter, a light reflector relatively reflective of light. The light reflector is discontinuous having an aperture formed therethrough. The present illumination device may specifically be characterized as an aperture fluorescent lamp assembly.

In accordance with another embodiment, the present invention is a fluorescent lamp assembly comprising in series a UV radiation source, a light selective filter, which is relatively transmissive of UV radiation and relatively reflective of light, and a phosphor which is fluorescable by UV radiation to emit light. The fluorescent lamp assembly may further comprise in series after the phosphor, a UV radiation selective filter, which is relatively transmissive of light and relatively reflective of UV radiation, and in series between the UV radiation source and the light selective filter, an internal tube, which is formed from a material relatively transmissive of UV radiation and also preferably relatively transmissive of light. The light selective filter preferably comprises a film of a light selective filter composition mounted on the internal tube. The UV radiation source is preferably a UV -emitting ionized gas and the internal tube is sealed to retain the gas therein. The fluorescent lamp assembly may further comprise in series after the phosphor, an external tube, which is formed from a material relatively transmissive of light and relatively absorbent of UV radiation. The internal tube is sized to be positioned in the external tube. The fluorescent lamp assembly may further comprise in series between the phosphor and the external tube, a UV radiation selective filter, which is relatively transmissive of light and relatively reflective of UV radiation. The UV radiation selective filter preferably comprises a film of a UV radiation selective filter composition mounted on the external tube.

The present invention is further a method for enhancing the luminous output of an illumination device. An outward-emitted fluorescing radiation is outwardly emitted from a fluorescing radiation source and propagated through a light selective filter to a light-emitting composition. The light-emitting composition is fluoresced with a first portion of the outward-emitted fluorescing radiation, thereby emitting an outward-emitted light from the light-emitting composition in a first direction away from the light selective filter and emitting an inward-emitted light from the light-emitting composition in a second direction toward the light selective filter. The inward-emitted light is reflected off of the light selective filter to propagate a reflected inward-emitted light in the first direction. The reflected inward-emitted light is propagated in the first direction through the light-emitting composition to combine with the outward-emitted light.

The method may further comprise propagating a second portion of the outward-emitted fluorescing radiation in the first direction through the light-emitting composition to a fluorescing radiation selective filter. The second portion of the outward-emitted fluorescing radiation is reflected off of the fluorescing radiation selective filter to propagate an inward-reflected fluorescing radiation in the second direction. The light-emitting composition is fluoresced with the inward-reflected fluorescing radiation, thereby emitting a supplemental light from the light-emitting composition in the first direction. The outward-emitted light and the supplemental light combine and are propagated in the first direction through the fluorescing radiation selective filter.

In accordance with an alternate method of the present invention for enhancing the luminous output of an illumination device, an outward-emitted UV radiation is outwardly emitted from a UV radiation source. The outward-emitted UV radiation is propagated to a light-emitting composition. The light-emitting composition is fluoresced with a first portion of the outward-emitted UV radiation, thereby emitting an outward-emitted light from the light-emitting composition in a first direction away from the UV radiation source. A second portion of the outward-emitted UV radiation is propagated in the first direction through the light-emitting composition to a UV radiation selective filter. The second portion of the outward-emitted UV radiation is reflected off of the UV radiation selective filter to propagate an inward-reflected UV radiation in a second direction toward the UV radiation source. The light-emitting composition is fluoresced with the inward-reflected UV radiation, thereby emitting a supplemental light from the light-emitting composition in the first direction. The outward-emitted light and the supplemental light are combined and propagated in the first direction through the UV radiation selective filter.

The method may further comprise emitting an inward-emitted light from the light-emitting composition in the second direction by fluorescing the light-emitting composition with the first portion of the outward-emitted UV radiation. The inward-emitted light is propagated to a light selective filter. The inward-emitted light is reflected off of the light selective filter to propagate a reflected inward-emitted light in the first direction. The reflected inward-emitted light is propagated in the first direction through the UV radiation selective filter to combine with the outward-emitted light.

The present invention will be further understood from the drawings and the following detailed description.

DESCRIPTION OF PREFERRED EMBODIMENTS

Figure 1:
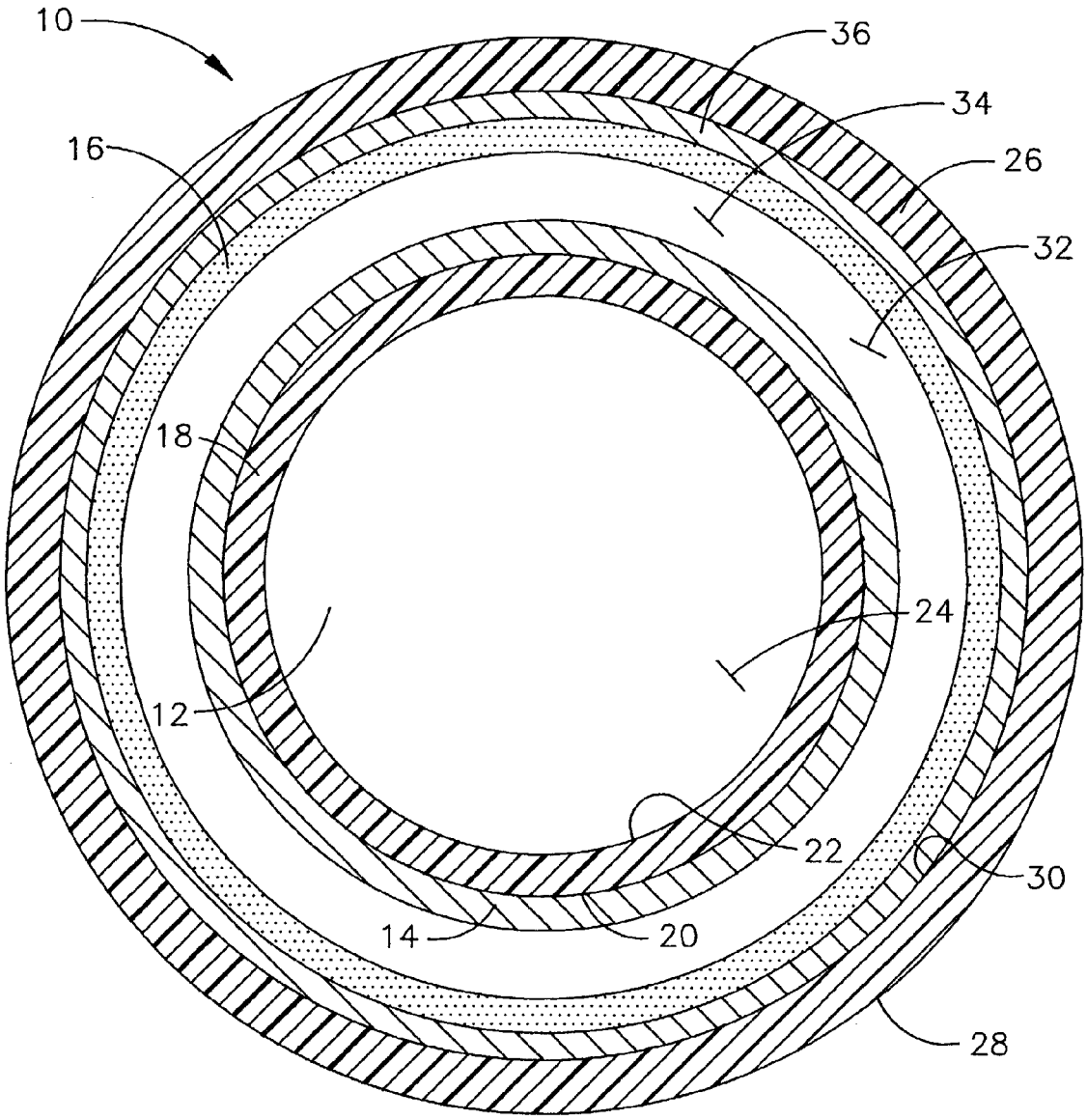
FIG. 1 is a conceptualized cross-sectional view of a fluorescent lamp assembly incorporating the features of the present invention.

The present invention is generally an illumination device having a plurality of functional components which are sequentially positioned relative to one another to increase the efficiency of the device. The functional components include in series a fluorescing radiation source, a light selective filter, and a light source. The functional components may further include a fluorescing radiation selective filter positioned in series following the light source.

The fluorescing radiation source is broadly characterized as an active component of the illumination device which emits radiation capable of fluorescing a phosphor. A preferred fluorescing radiation source comprises a composition of one or more materials which emits fluorescing radiation when energy is applied to the composition. Nevertheless, it is understood that the present invention is not limited to any one specific fluorescing radiation source.

In accordance with a specific embodiment of the present invention, the fluorescing radiation emitted by the fluorescing radiation source is UV radiation. UV radiation is electromagnetic radiation, which is in an approximate wavelength range of 180 to 400 nanometers. By comparison, light is electromagnetic radiation, which is in an approximate wavelength range of 400 to 700 nanometers, and infrared (IR) radiation is electromagnetic radiation, which is in an approximate wavelength range of 700 nanometers to 0.1 cm. Accordingly, UV radiation transitions to light as the wavelength of the UV radiation increases beyond about 400 nanometers. Conversely, light transitions to UV radiation as the wavelength of the light decreases below about 400 nanometers. Similarly, IR radiation transitions to light as the wavelength of the IR radiation decreases below about 700 nanometers and light transitions to IR radiation as the wavelength of the light increases above about 700 nanometers. It is understood that the above-recited wavelength ranges are provided as generalized reference points for the following description and, as such, need not necessarily be construed precisely by the skilled practitioner in the practice of the present invention. The terms "light" and "visible light" are used synonymously herein and refer to electromagnetic radiation which is visible to the human eye, i.e., is capable of causing the sensation of vision. In contrast, UV radiation and IR radiation are, for the most part, invisible to the human eye.

The light selective filter and fluorescing radiation selective filter are both broadly characterized as passive components of the illumination device which selectively filter electromagnetic radiation as a function of its wavelength. The selective filter transmits essentially all (i.e., most or all) electromagnetic radiation of a given wavelength through the selective filter, absorbing and/or reflecting essentially none (i.e., little or none) of the electromagnetic frequency of the given wavelength. The selective filter conversely prevents the transmission of essentially all electromagnetic radiation of a different wavelength through the selective filter, reflecting essentially all of the electromagnetic radiation of the different wavelength. Specifically, the light selective filter comprises a composition of one or more materials which selectively filters out light, i.e., prevents the transmission of essentially all light through the light selective filter by reflection, while transmitting essentially all fluorescing radiation through the light selective filter unimpeded. The fluorescing radiation selective filter comprises a composition of one or more materials which selectively filters out fluorescing radiation, i.e., prevents the transmission of essentially all fluorescing radiation through the fluorescing radiation selective filter by reflection, while transmitting essentially all of the light through the fluorescing radiation selective filter unimpeded.

Preferred embodiments of the light selective filter and fluorescing radiation selective filter are more specifically characterized as dichroic mirrors. A dichroic mirror is a configuration of a selective filter, wherein a film formed from one or more selective filter materials is supported on a substrate. The substrate is formed from one or more materials which are relatively non-selective with respect to electromagnetic radiation or at least with respect to light and fluorescing radiation, transmitting essentially all of the light and fluorescing radiation through the substrate unimpeded. The film transmits essentially all electromagnetic radiation of a given wavelength through the dichroic mirror, while reflecting back essentially all electromagnetic radiation of a different wavelength in the manner of one of the above-recited selective filters. A light selective dichroic mirror has a film of one or more materials which reflects essentially all light back while transmitting essentially all fluorescing radiation through the film. Conversely, a fluorescing radiation selective dichroic mirror has a film of one or more materials which reflects essentially all fluorescing radiation back while transmitting essentially all light through the film. Selective dichroic mirrors are generally known in the field of optics. For example, a range of selective dichroic mirrors for optical applications are available from Edmond Industrial Optics, 101 East Gloucester Pike, Barrington, N.J., U.S.A.

The light source is broadly characterized as an active component of the illumination device which emits light due to fluorescence. More particularly, the light source comprises a composition of one or more materials, either mixed or segregated, which emits light when energy is applied to and absorbed by the composition. For example, a preferred light-emitting composition is a phosphor, which emits light when a fluorescing radiation such as UV radiation is applied to and absorbed by the phosphor. As such, the phosphor converts the fluorescing radiation to light. The phosphor is preferably configured in the form of a coating which is supported on a substrate. The substrate is formed from one or more materials which are relatively non-selective with respect to light, transmitting essentially all of the light therethrough unimpeded. Although the above-recited exemplary light source is preferred in certain embodiments of the present invention, it is understood that the present invention is not limited to any one specific light source.

The illumination device described above in general terms has a plurality of specific embodiments for different applications, which are described hereafter. Specific embodiments of the illumination device, which are within the scope of the present invention, include a fluorescent lamp assembly, a flat panel display backlight assembly, and a white LED assembly.

Referring to FIG. 1, a fluorescent lamp assembly is shown and generally designated 10. The fluorescent lamp assembly 10 comprises in series a fluorescing radiation source 12, a light selective filter 14 and a light source 16. The fluorescing radiation source 12 is preferably a UV lamp. The UV lamp 12 comprises an internal tube 18 having an elongated cylindrical configuration which is characterized by an internal tube outer face 20, an internal tube inner face 22 and an internal tube interior 24. The terms "inner" or "internal" and "outer" or "external" are used in the present context to designate the relative positions of the recited elements along the radial axis of the fluorescent lamp assembly 10, wherein "inner" or "internal" is radially nearer the central longitudinal axis of the fluorescent lamp assembly 10 than "outer" or "external".

The internal tube 18 is formed from one or more materials which are relatively non-selective with respect to light and UV radiation, transmitting essentially all light and UV radiation therethrough unimpeded. A preferred internal tube 18 is formed from clear quartz glass or clear fused silica. The internal tube interior 24 is essentially a void space containing a composition of one or more materials which emits UV radiation when energy is applied to the composition. The internal tube 18 is sealed to the exterior to prevent fluid communication between the internal tube interior 24 and the exterior thereof, thereby retaining the UV radiation-emitting composition within the internal tube interior 24.

The UV radiation-emitting composition is preferably a gas, and most preferably a metal vapor, which emits UV radiation when sufficient electrical energy is applied to the gas to ionize the gas. The electrical energy is preferably applied to the UV radiation-emitting composition via electrical terminals (not shown in FIG. 1) of opposite polarity which are connected to a standard household circuit and are positioned at opposite ends (not shown) of the internal tube 24 in the manner of a conventional fluorescent lamp. Specific UV radiation-emitting compositions having utility in the present embodiment are preferably selected from a group consisting of mercury vapor, neon, argon, and mixtures thereof. Of this group, mercury vapor is most preferred. The predominant emission of ionized mercury vapor is UV radiation at a wavelength of 254 nanometers.

The light selective filter 14 is positioned between the internal tube interior 24 and the light source 16. Thus, the light selective filter 14 is internal to the light source 16, which is described in greater detail hereafter, and external to the internal tube interior 24. The light selective filter 14 is preferably mounted on the internal tube outer face 20, thereby interfacing with the exterior of the internal tube 18. In contrast, the internal tube inner face 22 is preferably essentially bare, thereby interfacing directly with the internal tube interior 24. Thus, the internal tube inner face 22 is free from any phosphors or any other light-emitting compositions positioned thereon. The light selective filter 14 comprises an essentially continuous film which essentially covers and encloses the entirety of the internal tube outer face 20, conforming to the surface contours of the internal tube outer face 20. As such, the internal tube 18 functions as a substrate to support the film which functions as the light selective filter 14.

The film is termed an optical thin film and is preferably configured in a plurality of layers, wherein each layer is a thin deposition of a different material. Each material is selected as a function of its given index of refraction. In particular, the layered materials of the light selective filter 14 are preferably selected such that each successive layer of the light selective filter 14 alternates between a layer consisting of a material having a high index of refraction and a layer of a material having a low index of refraction. The ultimate choice of specific materials for a given application of the light selective filter is within the purview of the skilled artisan.

The internal tube 18 and the light selective filter 14 in combination define a light selective dichroic mirror alternately termed a cold dichroic mirror. The light selective dichroic mirror 14, 18 prevents the transmission of essentially all (e.g., greater than about 90%) of the light through the light selective dichroic mirror 14, 18, reflecting essentially all of the light back toward the same side of the light selective dichroic mirror 14, 18 as the origin of the light. Conversely, the light selective dichroic mirror 14, 18 transmits essentially all (e.g., greater than about 90%) of the UV radiation through the light selective dichroic mirror 14, 18, reflecting essentially none (e.g., less than about 10%) of the UV radiation back toward the same side of the light selective dichroic mirror 14, 18 as the origin of the UV radiation.

The fluorescent lamp assembly 10 further comprises an external tube 26 in addition to the UV lamp 12, light selective dichroic mirror 14, 18 and light source 16. The external tube 26 has an elongated cylindrical configuration similar to that of the internal tube 18. The external tube 26 is characterized by an external tube outer face 28, an external tube inner face 30 and an external tube interior 32. The external tube outer face 28 is preferably essentially bare. The external tube interior 32 is essentially a void space and the cross-sectional diameter of the internal tube 18 is less than that of the external tube 26, which enables positioning of the internal tube 18 partially or completely in the external tube interior 32. As such, the terms "external" and "internal" are used in the present context to designate the relative positions of the recited elements, wherein the "internal" element is surrounded at least in part by the "external" element.

The length of the external tube 26 is preferably greater than or equal to the length of the internal tube 18. The central longitudinal axis of the internal tube 18 is preferably parallely aligned with that of the external tube 26, and more preferably concentrically aligned therewith. The cross-sectional diameter of the internal tube 18 is typically on the order of about 1.25 inches, while the cross-sectional diameter of the external tube 26 is typically on the order of about 1.5 inches. The cross-sectional diameter and length of the external tube 26 are approximately equal to those of a conventional fluorescent lamp which enables placement and use of the fluorescent lamp assembly 10 in a conventional fluorescent light fixture (not shown).

The relative cross-sectional diameters of the internal tube 18 and external tube 26 are such that an annulus 34 is defined between the internal tube outer face 20 and the external tube inner face 30. The width of the annulus 34 is the difference between the cross-sectional diameters of the internal tube 18 and external tube 26, i.e., typically on the order of about 0.2 inches. The annulus 34 is preferably filled with a dry inert gas and interfaces directly with the light selective filter 14.

The light source 16 is positioned external to the light selective dichroic mirror 14, 18 and is preferably mounted, either directly or indirectly, on the external tube inner face 30, thereby interfacing directly with the annulus 34. The light source 16 comprises an essentially continuous coating of a light-emitting composition of one or more materials, which covers essentially the entirety of the external tube inner face 30, conforming to the surface contours of the external tube inner face 30. As such, the external tube 26 functions as a substrate to support the light source 16. The light-emitting composition is preferably a solid which emits white light when UV radiation from the UV lamp 12 is applied to the light-emitting composition via the light selective dichroic mirror 14, 18. The light-emitting composition is more preferably a phosphor fluorescable by UV radiation to emit a broad spectrum white light or a tri-stimulus (red-green-blue) white light. An exemplary phosphor having utility herein is the type of tri-phosphor found in a conventional fluorescent lamp which emits a tri-stimulus white light.

The external tube 26 is formed from a material which is relatively non-selective with respect to light, transmitting essentially all light therethrough unimpeded. The material of the external tube 26 is preferably a standard clear glass, such as borosilicate glass used in a conventional fluorescent lamp. Such glass is also, although not necessarily, at least somewhat UV radiation selective, absorbing a substantial amount of UV radiation contacting the external tube 26. The ends (not shown) of the external tube 26 are sealed to prevent fluid communication between the external tube interior 32 and the exterior. The ends of the external tube 26 are also preferably sealed to the internal tube 18 to prevent fluid communication between the external tube interior 32 and the internal tube interior 24 and more particularly to prevent fluid communication between the annulus 34 and the internal tube interior 24, thereby protecting the light source 16.

Figure 2:
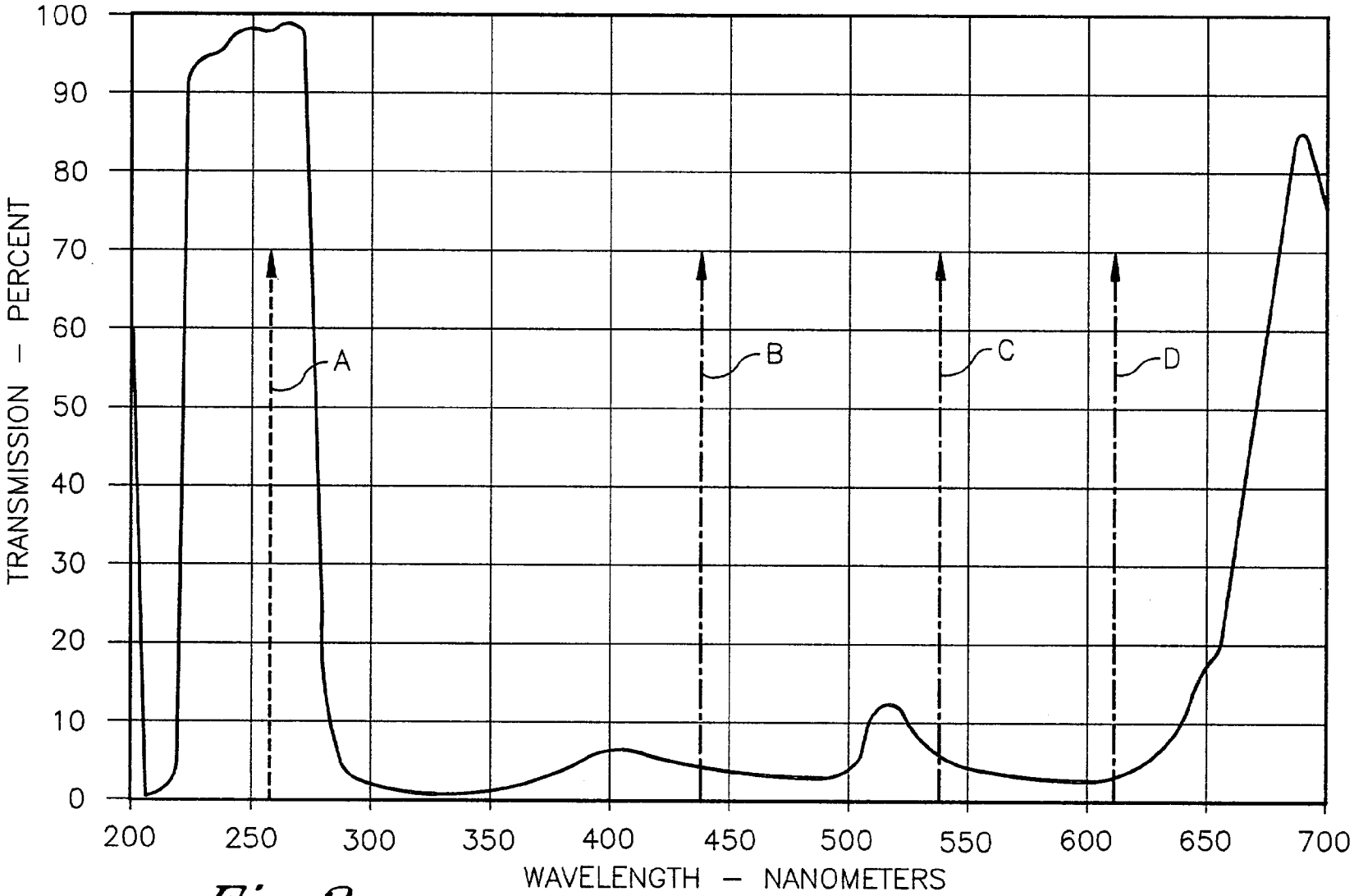
FIG. 2 is a graphical representation of the performance of a light selective dichroic mirror having utility in the fluorescent lamp assembly of FIG. 1.

FIG. 2 shows the performance of an exemplary light selective dichroic mirror having utility in the fluorescent lamp assembly 10. A dashed line A represents the peak UV radiation emission of a UV lamp containing ionized mercury vapor at 254 nanometers. Dashed lines B, C, and D represent the peak light emissions of a tri-phosphor light source. In particular, the dashed line B represents the peak blue light emission of the tri-phosphor light source at 440 nanometers, the dashed line C represents the peak green light emission of the tri-phosphor light source at 540 nanometers, and the dashed line D represents the peak red light emission of the tri-phosphor light source at 610 nanometers. A solid line E shows the performance of the light selective dichroic mirror as a function of transmission versus wavelength. The design of the light selective dichroic mirror is optimized to have a high transmission band centered about the peak UV radiation emission of the ionized mercury vapor at 254 nanometers. The design of the light selective dichroic mirror is further optimized to have high reflection at the tri-phosphor peak emissions of 440, 540, and 610 nanometers, respectively.

Referring back to FIG. 1, the fluorescent lamp assembly 10 optionally further comprises a fluorescing radiation selective filter 36. The fluorescing radiation selective filter 36 is positioned external to the light source 16. The fluorescing radiation selective filter 36 is preferably mounted on the external tube inner face 30 between the external tube inner face 30 and the light source 16, thereby interfacing with both the external tube inner face 30 and the light source 16. Thus, the light source 16 is said to be indirectly mounted on the external tube inner face 30 when the fluorescing radiation selective filter 36 is present insofar as the fluorescing radiation selective filter 36 intervenes between the light source 16 and the external tube inner face 30. However, the light source 16 is said to be directly mounted on the external tube inner face 30 when the fluorescing radiation selective filter 36 is not present insofar as there are no other intervening structures between the light source 16 and the external tube inner face 30.

In any case, the fluorescing radiation selective filter 36, if present, comprises an essentially continuous film which covers essentially the entirety of the external tube inner face 30, conforming to the surface contours of the external tube inner face 30. As such, the external tube 26 functions as a substrate to support both the light source 16 and the film which functions as the fluorescing radiation selective filter 36. The film is termed an optical thin film and is preferably configured in a plurality of layers (not separately shown). Each layer of the optical thin film is a thin deposition of a different material in a manner similar to the light selective filter 14 described above. The ultimate choice of the specific materials of the layers for a given application of the fluorescing radiation selective filter is within the purview of the skilled artisan.

The external tube 26 and the fluorescing radiation selective filter 36 in combination define a fluorescing radiation selective dichroic mirror alternately termed a hot dichroic mirror. The fluorescing radiation selective dichroic mirror 36, 26 prevents the transmission of essentially all (e.g., greater than about 90%) of the fluorescing radiation through the fluorescing radiation selective dichroic mirror 36, 26, reflecting essentially all of the fluorescing radiation back toward the same side of the fluorescing radiation selective dichroic mirror 36, 26 as the origin of the fluorescing radiation. Conversely, the fluorescing radiation selective dichroic mirror 36, 26 transmits essentially all (e.g., greater than about 90%) of the light through the fluorescing radiation selective dichroic mirror 36, 26, reflecting essentially none (e.g., less than about 10%) of the light back toward the same side of the fluorescing radiation selective dichroic mirror 36, 26 as the origin of the light. In sum, the design of the fluorescing radiation selective dichroic mirror 36, 26 is preferably optimized to have maximum reflection at 254 nanometers, maximum transmission from 400 to 650 nanometers, and a nominal transition at 350 nanometers.

In alternate configurations of the fluorescent lamp assembly not shown, the mounting surface for each or all of the light selective filter 14, light source 16 and optional fluorescing radiation selective filter 36 can be modified from those recited above. For example, in an alternate configuration of the fluorescent lamp assembly of the present invention, the light selective filter 14 is directly mounted on the internal tube inner face 22, the light source 16 is directly mounted on the internal tube outer face 20, and the optional fluorescing radiation selective filter 36 is indirectly mounted on the internal tube outerface 20 with the light source 16 intervening between the internal tube outer face 20 and the optional fluorescing radiation selective filter 36. It is apparent to the skilled artisan that any number of alternate direct or indirect mounting surfaces are available for the light selective filter 14, light source 16 and optional fluorescing radiation selective filter 36 of the fluorescent lamp assembly 10 within the scope of the present invention so long as the required sequence of elements is maintained, i.e., fluorescing radiation source 12, light selective filter 14, light source 16, and optional fluorescing radiation selective filter 36.

Figure 3:
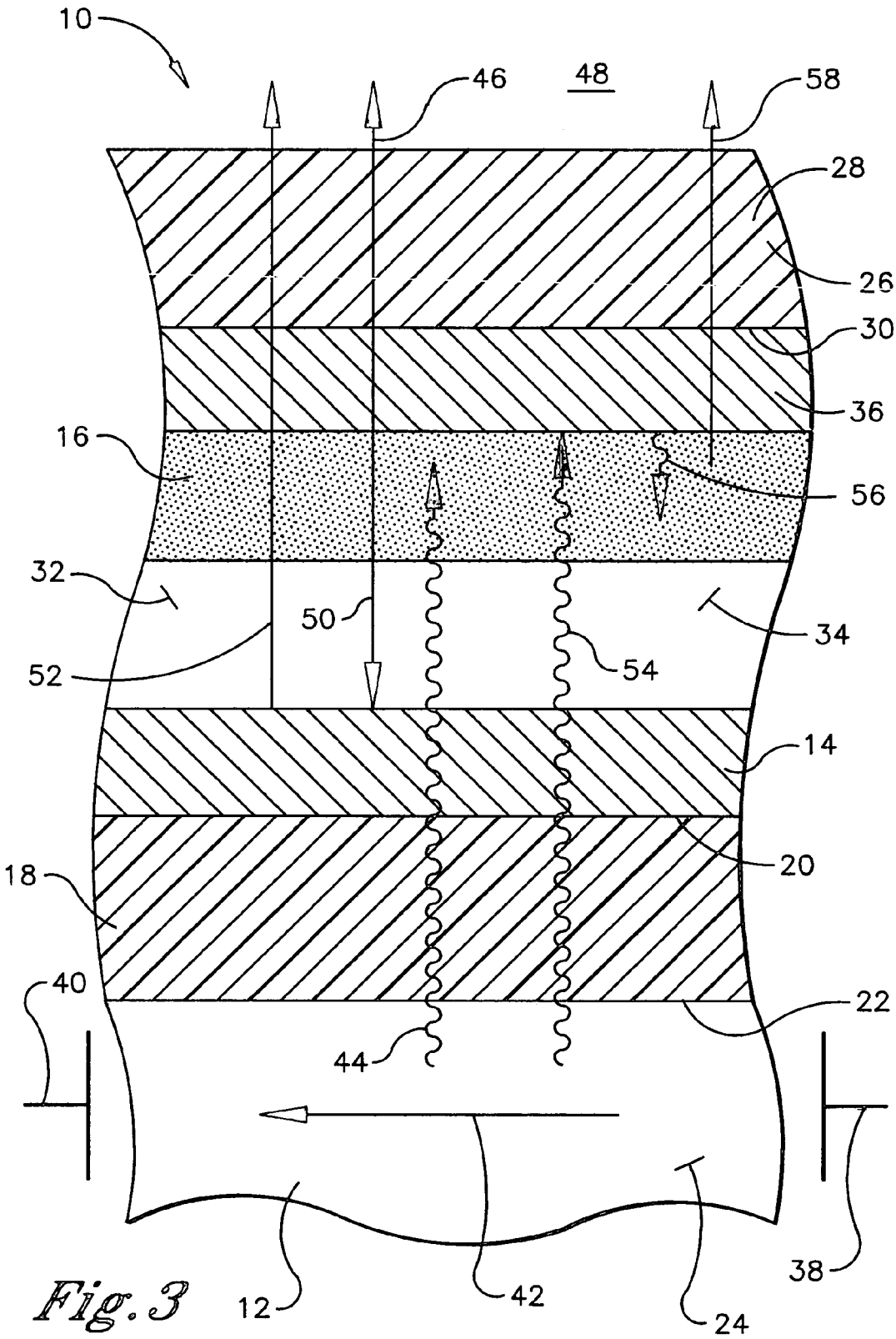
FIG. 3 is a conceptualized representation of the propagation of electromagnetic radiation during operation of the fluorescent lamp assembly of FIG. 1.

Operation of the fluorescent lamp assembly 10 is described with additional reference to FIG. 3, wherein elements in FIG. 3 which are common to FIG. 1 are designated by the same reference characters. To initiate operation, the UV lamp 12 is activated by applying voltage from a standard fluorescent lamp ballast between a terminal 38 and a terminal 40 of the UV lamp 12. A current, which is denoted by arrow 42, passes through the internal tube interior 24 from the terminal 38 to the terminal 40, thereby ionizing the gas in the internal tube interior 24. The ionized gas emits UV radiation radially outward from the internal tube interior 24, which is denoted by arrows 44. The outward-emitted UV radiation 44 propagates outwardly through the internal tube 18 and light selective dichroic mirror 14, 18 with minimal loss of outward-emitted UV radiation 44 due to absorption or reflection by the internal tube 18 or the light selective dichroic mirror 14, 18. The outward-emitted UV radiation 44 continues to propagate outwardly through the annulus 34 to the light source 16. The light source 16 fluoresces upon absorbing the outward-emitted UV radiation 44 after exposure thereto. The fluoresced light source 16 emits light radially outward, which is denoted by arrows 46. The outward-emitted light 46 propagates outwardly through the optional fluorescing radiation selective dichroic mirror 36, 26, if present, and the external tube 26 with minimal loss of outward-emitted light 46 due to absorption or reflection by the external tube 26 or the fluorescing radiation selective filter 36. As such, the outward-emitted light 46 illuminates the surroundings 48 exterior to the external tube 26.

The fluoresced light source 16 also emits light radially inward, which is denoted by arrows 50. The inward-emitted light 50 propagates inwardly through the annulus 34 to the light selective dichroic mirror 14, 18 which reflects the inward-emitted light back through the annulus 34 in a radially outward direction. The reflected inward-emitted light, which is denoted by arrows 52, propagates outwardly through the optional fluorescing radiation selective dichroic mirror 36, 26, if present, and the external tube 26 to supplement the outward-emitted light 46 in illuminating the surroundings 48.

A small portion of the outward-emitted UV radiation 44 usually propagates outwardly through the light source 16 without being absorbed thereby. If the optional fluorescing radiation selective dichroic mirror 36, 26 is present, the fluorescing radiation selective dichroic mirror 36, 26 reflects the unabsorbed outward-emitted UV radiation, which is denoted by arrows 54, back into the light source 16 in a radially inward direction. The reflected unabsorbed outward-emitted UV radiation, which is denoted by arrows 56, is absorbed by and fluoresces the light source 16 to emit supplemental light denoted by arrows 58.

It is apparent from the above that the fluorescent lamp assembly 10 exhibits improved performance relative to conventional fluorescent lamps on the basis of several performance criteria. The fluorescent lamp assembly 10 maximizes the amount of light which is directed radially outward from the fluorescent lamp assembly 10, while minimizing attenuation of the UV radiation. In particular, the light output efficiency, i.e., the total luminous output of the fluorescent lamp assembly 10 as a percentage of the total light generated by the light source 16, is enhanced. The luminous efficacy of the fluorescent lamp assembly 10, which is the ratio of total luminous flux output to total electric power input, is also enhanced. In addition, use of the optional fluorescing radiation selective dichroic mirror 36, 26 advantageously enables a reduction in the thickness of the light source 16 as compared to conventional fluorescent lamps. Although less outward-emitted UV radiation 44 is absorbed by the thinner light source 16, the UV radiation conversion efficiency of the fluorescent lamp assembly 10 is not diminished because the fluorescing radiation selective dichroic mirror 36, 26 returns the unabsorbed UV radiation 54 to the light source 16 where the unabsorbed UV radiation 54 is ultimately absorbed by the light source 16.

Figure 4:
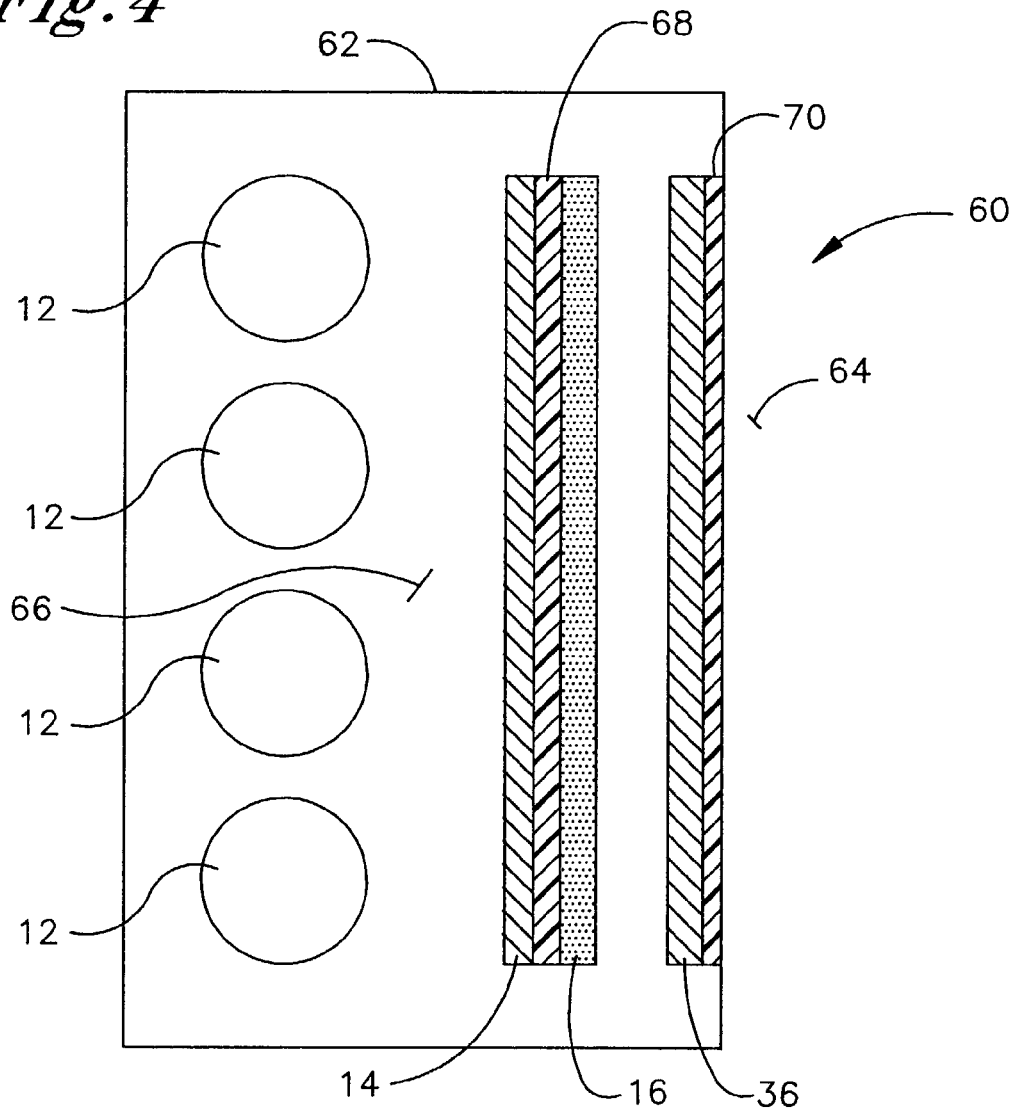
FIG. 4 is a conceptualized cross-sectional view of a flat panel display backlight assembly incorporating the features of the present invention.

Referring to FIG. 4, a flat panel display backlight assembly is shown and generally designated 60. The flat panel display backlight assembly 60 is an alternate embodiment of the illumination device of the present invention. Elements in FIG. 4 which are common to FIG. 1 are designated by the same reference characters. The flat panel display backlight assembly 60 comprises in series a fluorescing radiation source 12, a light selective filter 14 and a light source 16 all retained within a housing 62. The housing 62 is preferably formed from an opaque material which transmits neither light nor fluorescing radiation. The housing 62 has a front opening 64 across which a fluorescing radiation selective filter 36 can optionally be positioned. The fluorescing radiation source 12 is a plurality of UV lamps. The UV lamps are substantially similar to those described above. However, the electrical terminals (not shown) of the UV lamps 12 are typically connected to the internal power source (not shown) of the flat panel display backlight assembly 60 rather than to a household circuit.

The light selective filter 14 is positioned in series adjacent to the UV lamps 12 with a void space 66 therebetween. The light selective filter 14 comprises an essentially continuous film of a light selective composition of one or more materials. A flat continuous planar inner substrate 68 is preferably provided to support the light selective filter 14, which conforms to and covers the flat inner surface of the inner substrate 68 in its entirety. The light selective filter 14 typically has the same thickness, layered configuration, and composition as described above with reference to the fluorescent lamp assembly 10 of FIG. 1. The inner substrate 68 preferably has essentially the same transmission characteristics with respect to light and UV radiation as the internal tube 18 recited above. The inner substrate 68 and the light selective filter 14 in combination define a light selective dichroic mirror. The terms "inner" and "outer" are used in the present context to designate the relative positions of the recited elements with respect to the UV lamps 12, wherein "inner" is nearer the UV lamps 12 than "outer".

The light source 16 is positioned on the side of the light selective filter 14 opposite the UV lamps 12 and more proximal to the front opening 64. The light source 16 is mounted directly on the flat outer surface of the inner substrate 68. The light source 16 comprises an essentially continuous coating of a light-emitting composition which is supported by, conforms to and covers the flat surface of the inner substrate 68 in its entirety. The light source 16 typically has the same thickness and composition as described above with reference to the fluorescent lamp assembly 10 of FIG. 1. In an embodiment not shown, the light selective filter 14 and light source 16 are both alternately mounted on the outer surface of the inner substrate 68. As such, the light source 16 is indirectly mounted on the inner substrate 68 with the light selective filter 14 intervening between the light source 16 and inner substrate 68.

When the flat panel display backlight assembly 60 is provided with the fluorescing radiation selective filter 36, the fluorescing radiation selective filter 36 is positioned outer to the light source 16 and preferably, as noted above, across the front opening 64 of the housing 62. The fluorescing radiation selective filter 36 comprises an essentially continuous film of a fluorescing radiation selective composition of one or more materials. A flat continuous planar outer substrate 70 is preferably provided to support the fluorescing radiation selective filter 36, which conforms to and covers the flat inner surface of the outer substrate 70 in its entirety. The fluorescing radiation selective filter 36 typically has the same thickness, layered configuration, and composition as described above with reference to the fluorescent lamp assembly 10 of FIG. 1. The outer substrate 70 preferably has essentially the same transmission characteristics with respect to light and UV radiation as the external tube 26 recited above. The outer substrate 70 and the fluorescing radiation selective filter 36 in combination define a fluorescing radiation selective dichroic mirror.

When the optional fluorescing radiation selective dichroic mirror 36, 70 is provided, the light source 16 can alternately be mounted (in an embodiment not shown) either directly or indirectly on the outer substrate 70, i.e., with or without the fluorescing radiation selective filter 36 intervening between the light source 16 and the outer substrate 70. In this case, the light source 16 is supported by and conforms to the flat inner surface of the outer substrate 70, rather than the inner substrate 68, and the fluorescing radiation selective filter 36 is always outer to the light source 16.

The flat panel display backlight assembly 60 is positioned behind a downstream display (not shown), for example, a liquid crystal display (LCD), wherein the outward-emitted light and reflected inward-emitted light from the flat panel display backlight assembly 60 are directed at the downstream display. The flat panel display backlight assembly 60 exhibits improved performance in a manner substantially similar to the fluorescent lamp assembly 10. In addition to enhancing the luminous output and luminous efficacy of the flat panel display backlight assembly 60, the light selective filter 14 eliminates the need to control inward-emitted light in the housing 62 as in conventional flat panel display backlights. Therefore, the surfaces within the housing 62 can be optimized to advantageously reflect fluorescing radiation outward toward the light source 16. Furthermore, the optional fluorescing radiation selective dichroic mirror 36, 70, if present, reduces the level of unabsorbed fluorescing radiation in the light path downstream of the light source 16, which increases the operational life of the downstream display.

Figure 5:
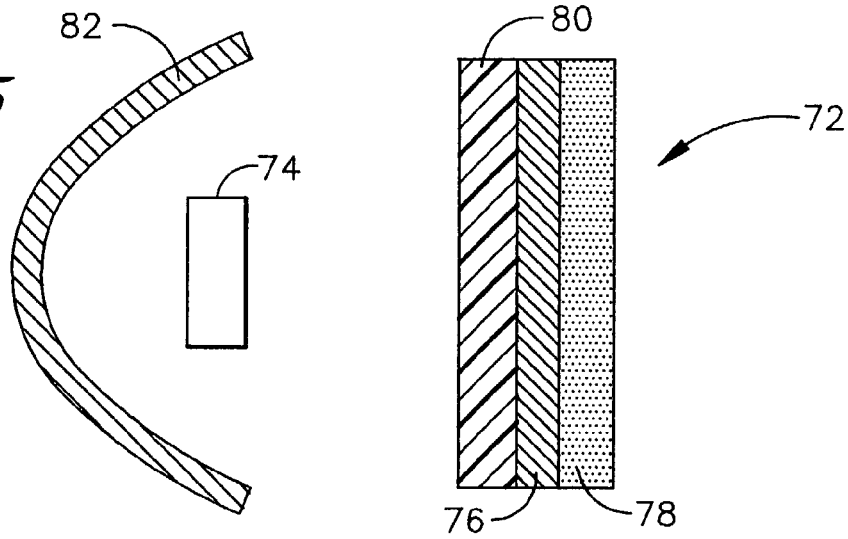
FIG. 5 is a conceptualized cross-sectional view of a white LED assembly incorporating the features of the present invention.

Referring to FIG. 5, a white LED assembly is shown and generally designated 72. The white LED assembly 72 is an alternate embodiment of the illumination device of the present invention. The white LED assembly 72 comprises in series a combined fluorescing radiation and light source 74, a light selective filter 76, and a light source 78. The combined fluorescing radiation and light source 74 is a blue LED which emits electromagnetic radiation at the wavelength of blue light, i.e., about 470 nanometers. Blue LED's having utility in the present invention are available from Nichia Corporation, 491 Oka, Kaminaka-Cho, Anan-Shi, Tokushima 774-9601, Japan.

The light selective filter 76 comprises an essentially continuous film having a layered configuration of materials similar to that of the light selective filter 14 described above with reference to the fluorescent lamp assembly 10 of FIG. 1. However, the materials of the light selective filter 76 are preferably selected so that the light selective filter 76 exhibits maximum transmission of light in an approximate wavelength range of 400 to 500 nanometers, maximum reflection in an approximate wavelength range of 500 to 700 nanometers, and a transition at about 500 nanometers. The wavelength range of 400 to 500 nanometers encompasses the blue spectrum while the wavelength range of 500 to 700 nanometers encompasses the green and red spectrums. Thus, the light selective filter 76 effectively transmits blue light, which functions in part as the fluorescing radiation in a manner described below, while effectively reflecting green and red light.

A flat continuous planar substrate 80 is preferably provided a distance forward of the combined fluorescing radiation and light source 74. The substrate 80 is formed from a material which is relatively non-selective with respect to light, transmitting essentially all light therethrough unimpeded in the manner of the external tube 18 described above with reference to the fluorescent lamp assembly 10. The substrate 80 supports the light selective filter 76, which is mounted directly or indirectly thereon. The light selective filter 76 is preferably directly mounted on the outer surface of the substrate 80, conforming to and covering the outer surface in its entirety. The substrate 80 and the light selective filter 76 in combination define a light selective dichroic mirror.

The light source 78 is positioned forward of the light selective dichroic mirror 76, 80. The light source 78 is preferably mounted, either directly or indirectly, on the substrate 80 and is more preferably mounted indirectly on the outer surface of the substrate 80, conforming to and covering the outer face of the light selective filter 76 in its entirety. The light source 78 comprises an essentially continuous coating of a composition of one or more materials, which emits green and red light when fluorescing radiation (i.e., blue light) from the combined fluorescing radiation and light source 74 is applied to the light-emitting composition via the light selective dichroic mirror 76, 80. The light-emitting composition is preferably a phosphor, termed a di-phosphor, which emits green and red light when fluoresced by blue light.

Figure 6:
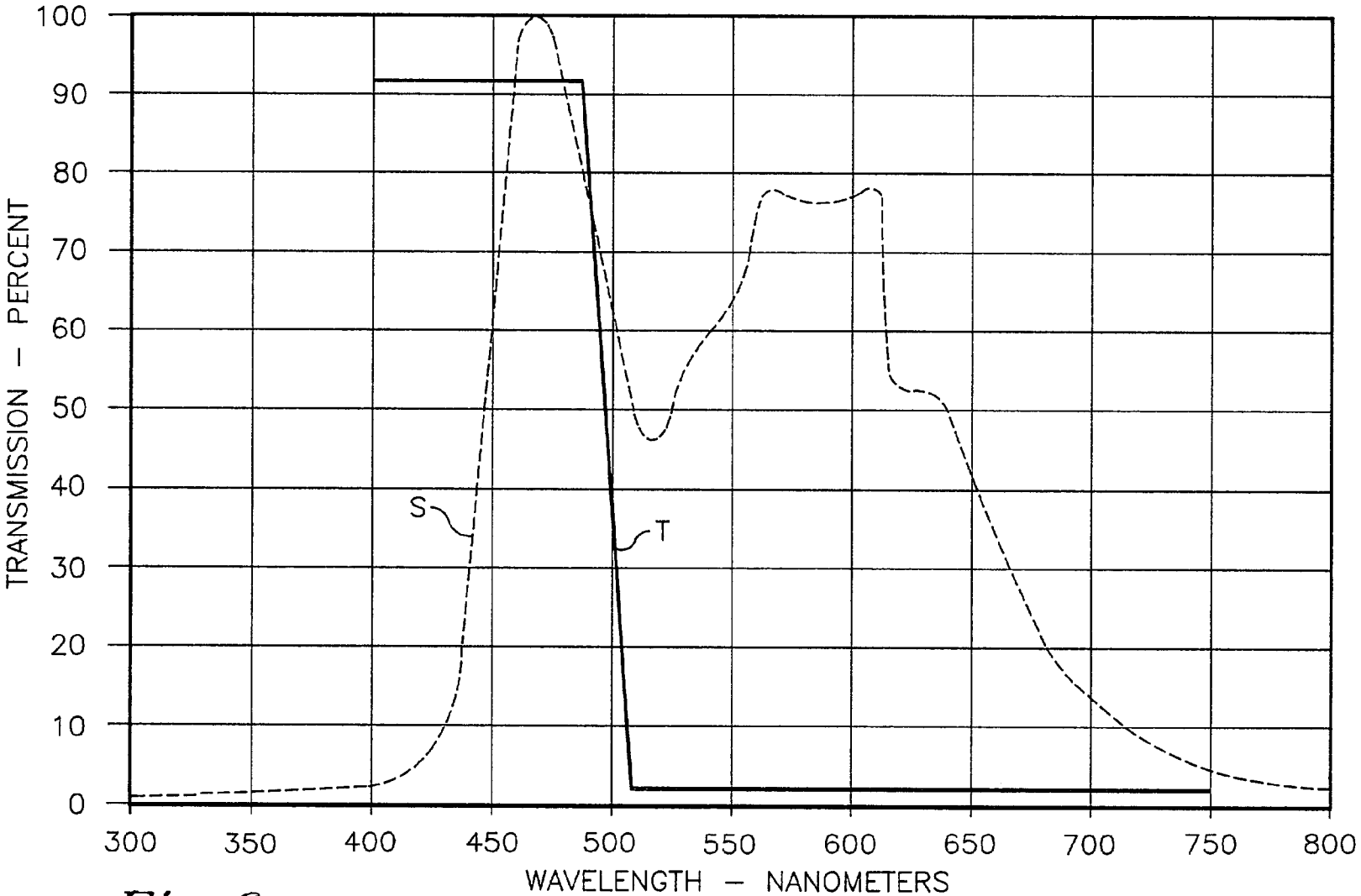
FIG. 6 is a graphical representation of the performance of a light selective dichroic mirror having utility in the white LED assembly of FIG. 5.

FIG. 6 shows the performance of an exemplary light selective dichroic mirror having utility in the white LED assembly 72. A dashed line S represents the peak light emissions of a blue LED (combined fluorescing radiation and light source) and a di-phosphor (light source). In particular, the dashed line S has a blue peak due to the blue LED emission at 470 nanometers and a broad green and red peak due to the green-red di-phosphor emission from 500 to 650 nanometers. A such, the dashed line S is essentially the white light spectrum. A solid line T shows the performance of the light selective dichroic mirror as a function of transmission versus wavelength. As noted above, the design of the light selective dichroic mirror is optimized to have a maximum transmission from 400 to 500 nanometers, maximum reflection from 500 to 700 nanometers and a nominal transition at 500 nanometers.

Referring back to FIG. 5, a light reflector 82 is preferably provided a distance behind the combined fluorescing radiation and light source 74. The light reflector 82 is formed from a material which is relatively non-selective with respect to light, reflecting essentially all light contacting the light reflector 82. The light reflector 82 is specifically configured to effect a desired distribution of reflected blue light which has been directed backward onto the reflector 82 from the combined fluorescing radiation and light source 74. For example, the reflector 82 can have a parabolic shape or other complex curved contours as desired.

Operation of the white LED assembly 72 differs from the above-recited illumination devices 10, 60 insofar as a specific wavelength of electromagnetic radiation (i.e., blue light at 470 nanometers) functions both as fluorescing radiation and as a portion of the visible light emitted by the white LED assembly 72 in a manner described hereafter. Operation of the white LED assembly 72 is initiated by electrically activating the combined fluorescing radiation and light source 74 which emits blue light radially outwardly from the combined fluorescing radiation and light source 74 upon activation. Forward-emitted blue light propagates through the light selective dichroic mirror 76, 80 to the light source 78, while upward-, downward-, and backward-emitted blue light propagates onto the reflector 82 and where it is reflected forward. The forward-reflected blue light combines with the forward-emitted blue light and likewise propagates through the light selective dichroic mirror 76, 80 to the light source 78. As such, there is minimal loss of outward-emitted blue light to the surroundings.

A portion of the combined forward-emitted and forward-reflected blue light is absorbed by the light source 78 upon contact. The absorbed portion of the combined forward-emitted and forward-reflected blue light is termed the fluorescing portion. The absorbed portion of the combined emitted and reflected blue light fluoresces the light source 78, causing the light source 78 to emit green and red light in a substantially forward and backward direction. The backward-emitted green and red light propagates onto the light selective dichroic mirror 76, 80 where it is reflected forward. The forward-reflected green and red light combines with the forward-emitted green and red light both of which propagate forward into the surroundings.

The remaining portion of the combined forward-emitted and forward-reflected blue light which is not absorbed by the light source 78 is transmitted forward through the light source 78. Thus, the remaining portion of the blue light, which is termed the illumination portion, likewise propagates forward into the surroundings past the light source 78 in combination with the forward-reflected green and red light and forward-emitted green and red light. The combined contributions of the blue light and green and red light produce a "white light" which effectively illuminates the surroundings in front of the white LED assembly 72 with a minimal loss of separate blue light or green and red light to the surroundings. It is apparent from the above that the white LED assembly 72 exhibits improved performance in a manner analogous to the fluorescent lamp assembly 10 and flat panel display backlight assembly 60 described above.

Figure 7:
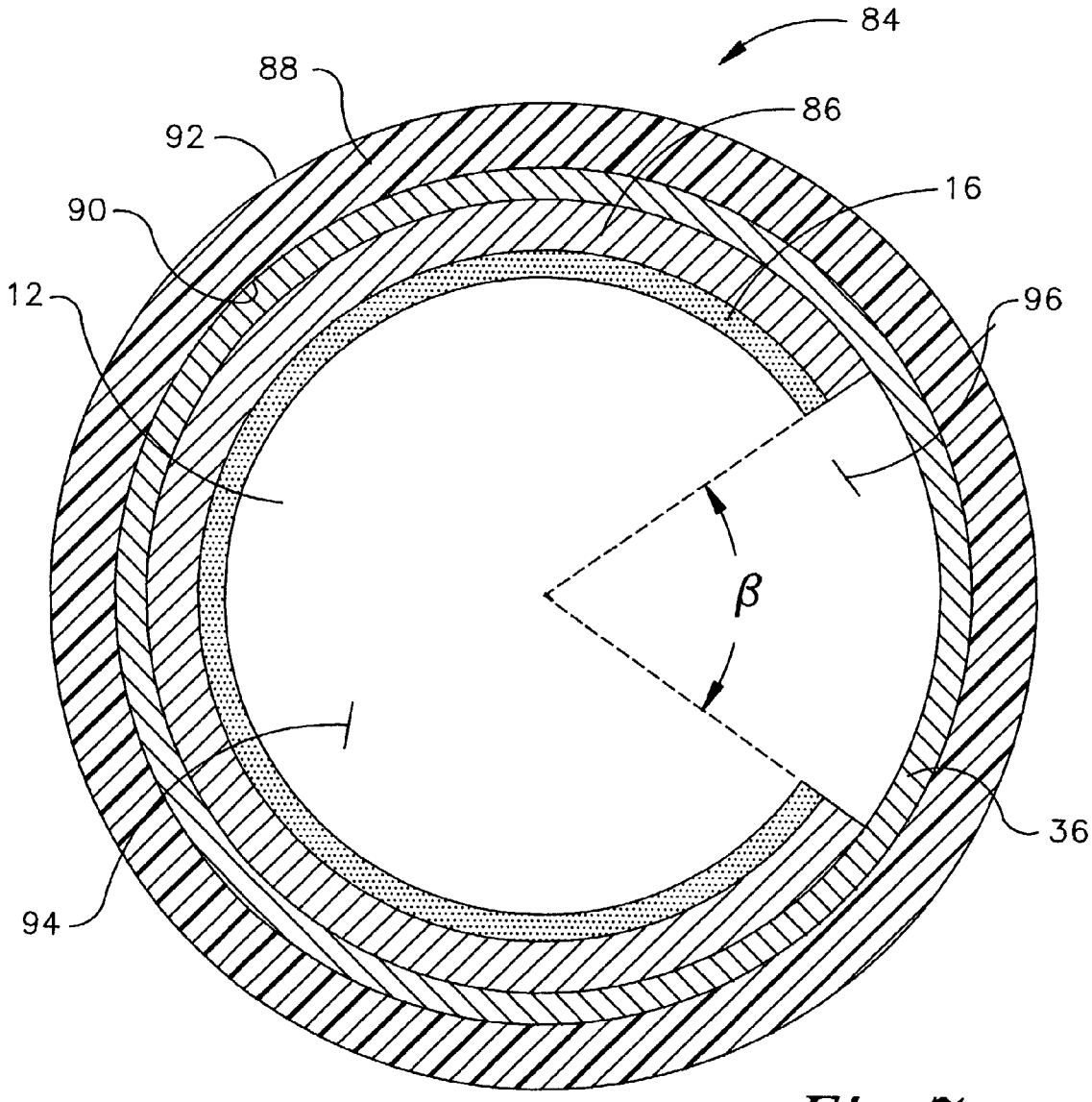
FIG. 7 is a conceptualized cross-sectional view of an aperture fluorescent lamp assembly incorporating the features of the present invention.

Referring to FIG. 7, an aperture fluorescent lamp assembly is shown and generally designated 84. The aperture fluorescent lamp assembly 84 is an alternate embodiment of the illumination device of the present invention. Elements in FIG. 7 which are common to FIG. 1 are designated by the same reference characters. The aperture fluorescent lamp assembly 84 comprises in series a fluorescing radiation source 12, a light source 16, a light reflector 86, and a fluorescing radiation selective filter 36. The aperture fluorescent lamp assembly 84 is enclosed within a single tube 88 having substantially the same characteristics of the external tube 26 described above with reference to the fluorescent lamp assembly 10 of FIG. 1. The single tube 88 is characterized by a single tube inner face 90, a single tube outer face 92 and a single tube interior 94. The single tube outer face 92 is preferably essentially bare. The fluorescing radiation selective filter 36 is preferably directly mounted on the single tube inner face 90. Thus, the single tube 88 supports the fluorescing radiation selective filter 36, which conforms to and covers the surface contours of the single tube inner face 90 in their entirety. The fluorescing radiation selective filter 36 comprises an essentially continuous film of a fluorescing radiation selective composition of one or more materials. The fluorescing radiation selective filter 36 typically has the same thickness, layered configuration, and composition as described above with reference to the fluorescent lamp assembly 10 of FIG. 1. The single tube 88 and fluorescing radiation selective filter 36 in combination define a fluorescing radiation selective dichroic mirror.

The single tube interior 94 is essentially a void space containing a UV radiation-emitting composition, which is the fluorescing radiation source 12 and is essentially as described above with reference to the fluorescent lamp assembly 10 of FIG. 1. The light reflector 86 is a thin sheath of light reflective material which is indirectly mounted on the single tube inner face 90 with the fluorescing radiation selective filter 36 intervening therebetween. The light reflector 86 conforms to the surface contours of the single tube inner face 90 and may be formed from any material, which is highly reflective of light, such as the one or more light selective filter materials described above with reference to the previous embodiments.

The light source 16 is a coating of a light-emitting composition, which is also preferably indirectly mounted on the single tube inner face 90 with the light reflector 86 and fluorescing radiation selective filter 36 intervening therebetween. The light source 16 conforms to the surface contours of the single tube inner face 90 and preferably has the same thickness and composition as described above with reference to the fluorescent lamp assembly 10 of FIG. 1. Thus, the sequential positioning of the elements of the aperture fluorescent lamp assembly 84 from the inside out is the light source 16, light reflector 86, fluorescing radiation selective filter 36, and single tube 88. The light source 16 and light reflector 80 have a longitudinal aperture 96 formed therein defined by an aperture angle β of about 30° to 90°, which extends the length of the single tube 88, preferably substantially parallel to the central longitudinal axis of the single tube 88.

Operation of the aperture fluorescent lamp assembly 84 is effected by generating UV radiation in substantially the same manner as described above with reference to the fluorescent lamp assembly 10 of FIG. 1. Outward-emitted UV radiation propagates outwardly to the light source 16. The light source 16 emits light radially inward and outward in response to the outward-emitted UV radiation. The light reflector 86 directs all of the emitted light through the aperture 96 and fluorescing radiation selective dichroic mirror 36, 88 into the surroundings exterior to the single tube 88. As such, the emitted light produces a narrow band of light, which illuminates the aperture 96. The fluorescing radiation selective dichroic mirror 36, 88 reflects any outward-emitted UV radiation propagating through the aperture 96 back to the light source 16 where the reflected UV radiation is absorbed and converted to light for outward transmission through the aperture 96 and fluorescing radiation selective dichroic mirror 36, 88 into the surroundings. Accordingly, the aperture fluorescent lamp assembly 84 exhibits improved performance by maximizing utilization of the outward-emitted UV radiation.

Although not shown in the drawings or described above, it is noted that an interface layer of a barrier material is preferably provided at any interface between a light-emitting composition of a light source and an optical thin film of a selective filter, should any of the above-described illumination devices be configured so that such an interface exists. The light-emitting composition of the light sources and the optical thin film of the selective filters are typically porous in nature, which could result in undesirable contamination of one another by mixing if they permitted to directly contact one another. The interface layer is an essentially inactive barrier material, which is fully transmissive of both light and UV radiation, but prevents contact or communication between a selective filter and an adjacent light source. For example, the barrier material of the interface layer may be a protective varnish, a Mylar sheet, or the like.

While the forgoing preferred embodiments of the invention have been described and shown, it is understood that alternatives and modifications, such as those suggested and others, may be made thereto and fall within the scope of the invention.

I claim:

1. An illumination device comprising in series:

a fluorescing radiation source;

a light selective filter relatively transmissive of fluorescing radiation and relatively reflective of light;

a light source;

a fluorescing radiation selective filter relatively transmissive of light and relatively reflective of fluorescing radiation.

2. The illumination device of claim 1, wherein said light selective filter comprises a film of a light selective filter composition.

3. The illumination device of claim 1, wherein said fluorescing radiation selective filter comprises a film of a fluorescing radiation selective filter composition.

4. The illumination device of claim 1, wherein said light source is a fluorescable phosphor emitting white light when fluoresced.

5. The illumination device of claim 1, wherein said fluorescing radiation source is an ionizable gas emitting ultraviolet radiation when ionized.

6. The illumination device of claim 1, wherein said fluorescing radiation source is a blue LED emitting blue light when activated.

7. The illumination device of claim 6, wherein said light source is a fluorescable phosphor emitting green and red light when fluoresced.

8. The illumination device of claim 7, wherein said light selective filter is relatively transmissive of said blue light and relatively reflective of said green and red light.

9. The illumination device of claim 1, wherein said illumination device is a white LED assembly.

10. The illumination device of claim 1, wherein said illumination device is a fluorescent lamp assembly.

11. The illumination device of claim 1, wherein said illumination device is a flat panel display backlight assembly positionable behind a flat panel display.

12. An illumination device comprising in series:

a fluorescing radiation source;

a light source; and a fluorescing radiation selective filter relatively transmissive of light and relatively reflective of fluorescing radiation.

13. The illumination device of claim 12 further comprising in series between said light source and said fluorescing radiation selective filter, a light reflector relatively reflective of light.

14. The illumination device of claim 13 wherein said light reflector is discontinuous having an aperture formed therethrough.

15. The illumination device of claim 12, wherein said illumination device is an aperture fluorescent lamp assembly.

16. A fluorescent lamp assembly comprising in series:

an ultraviolet radiation source;

a light selective filter relatively transmissive of ultraviolet radiation and relatively reflective of light;

a phosphor fluorescable by ultraviolet radiation to emit light; and an ultraviolet radiation selective filter relatively transmissive of light and relatively reflective of ultraviolet radiation.

17. The fluorescent lamp assembly of claim 16 further comprising in series between said ultraviolet radiation source and said light selective filter, an internal tube formed from a material relatively transmissive of ultraviolet radiation.

18. The fluorescent lamp assembly of claim 17 wherein said material of said internal tube is relatively transmissive of light.

19. The fluorescent lamp assembly of claim 17 wherein said light selective filter comprises a film of a light selective filter composition mounted on said internal tube.

20. The fluorescent lamp assembly of claim 16 wherein said ultraviolet radiation source is an ionizable gas emitting ultraviolet radiation when ionized.

21. The fluorescent lamp assembly of claim 17 further comprising in series after said phosphor, an external tube formed from a material relatively transmissive of light, wherein said internal tube is positioned in said external tube.

22. The fluorescent lamp assembly of claim 21 wherein said ultraviolet radiation selective filter comprises a film of an ultraviolet radiation selective filter composition mounted on said external tube.

23. The fluorescent lamp assembly of claim 21 wherein said material of said external tube is relatively absorbent of ultraviolet radiation.

24. A method for enhancing the luminous output of an illumination device comprising:

outwardly emitting an outward-emitted fluorescing radiation from a fluorescing radiation source;

propagating said outward-emitted fluorescing radiation through a light selective filter relatively transmissive of fluorescing radiation and relatively reflective of light;

fluorescing a light-emitting composition with said outward-emitted fluorescing radiation, thereby emitting an outward-emitted light from said light-emitting composition in a first direction away from said light selective filter and an inward-emitted light from said light-emitting composition in a second direction toward said light selective filter;

reflecting said inward-emitted light off of said light selective filter to propagate a reflected inward-emitted light in said first direction; and propagating said reflected inward-emitted light in said first direction through said light-emitting composition.

25. The method of claim 24, wherein said fluorescing radiation source is a blue LED and said outward-emitted fluorescing radiation is blue light and further wherein said light-emitting composition is a fluorescable phosphor and said outward-emitted light and said reflected inward-emitted light are a green and red light.

26. The method of claim 25, wherein said outward-emitted fluorescing radiation is a first portion of said blue light, said method further comprising emitting a second portion of said blue light from said blue LED and propagating said second portion of said blue light through in said first direction through said light-emitting composition.

27. The method of claim 26 further comprising combining said propagated second portion of said blue light with said outward-emitted light and said reflected inward-emitted light are a green and red light to form a white light.

28. The method of claim 24, wherein said outward-emitted fluorescing radiation fluorescing said light-emitting composition is a first portion of said outward-emitted fluorescing radiation, said method further comprising propagating a second portion of said outward-emitted fluorescing radiation in said first direction through said light-emitting composition to a fluorescing radiation selective filter, reflecting said second portion of said outward-emitted fluorescing radiation off of said fluorescing radiation selective filter to propagate an inward-reflected fluorescing radiation in said second direction, fluorescing said light-emitting composition with said inward-reflected fluorescing radiation, thereby emitting a supplemental light from said light-emitting composition in said first direction, and propagating said outward-emitted light and said supplemental light in said first direction through said fluorescing radiation selective filter.

29. The method of claim 24, wherein said illumination device is a fluorescent lamp assembly.

30. A method for enhancing the luminous output of an illumination device comprising:

outwardly emitting an outward-emitted ultraviolet radiation from an ultraviolet radiation source;

propagating said outward-emitted ultraviolet radiation through a light selective filter relatively transmissive of ultraviolet radiation and relatively reflective of light;

fluorescing a light-emitting composition with said outward-emitted ultraviolet radiation, thereby emitting an outward-emitted light from said light-emitting composition in a first direction away from said light selective filter and an inward-emitted light from said light-emitting composition in a second direction toward said light selective filter;

reflecting said inward-emitted light off of said light selective filter to propagate a reflected inward-emitted light in said first direction; and propagating said reflected inward-emitted light in said first direction through said light-emitting composition.

* * * * *